US008118955B2

(12) United States Patent
Zavitsanos et al.

(10) Patent No.: US 8,118,955 B2
(45) Date of Patent: Feb. 21, 2012

(54) THERMOBARIC MATERIALS AND DEVICES FOR CHEMICAL/BIOLOGICAL AGENT DEFEAT

(75) Inventors: Peter D. Zavitsanos, Gwynedd Valley, PA (US); Anthony J. Rozanski, Macungle, PA (US); Thomas Manion, Hereford, PA (US)

(73) Assignee: General Sciences Incorporated, Souderton, PA (US)

( * ) Notice: Subject to any disclaimer, the term of this patent is extended or adjusted under 35 U.S.C. 154(b) by 1104 days.

(21) Appl. No.: 11/786,324

(22) Filed: Apr. 11, 2007

(65) Prior Publication Data

US 2008/0251170 A1 Oct. 16, 2008

(51) Int. Cl.
*C06B 45/10* (2006.01)
*C06B 43/00* (2006.01)

(52) U.S. Cl. ..... 149/19.3; 149/22; 102/287

(58) Field of Classification Search ..... 149/19.3, 149/22

See application file for complete search history.

(56) References Cited

U.S. PATENT DOCUMENTS

| | | | | |
|---|---|---|---|---|
| 6,792,866 | B2 * | 9/2004 | Grattan | 102/310 |
| 6,808,572 | B2 | 10/2004 | Miskelly, Jr. | |
| 6,945,175 | B1 | 9/2005 | Gotzmer et al. | |
| 6,955,732 | B1 * | 10/2005 | Chan et al. | 149/92 |
| 6,979,758 | B2 | 12/2005 | Eidelman et al. | |

* cited by examiner

*Primary Examiner* — Aileen B Felton
(74) *Attorney, Agent, or Firm* — RatnerPrestia

(57) ABSTRACT

A thermobaric self-sustaining reactive composition, method and device for defeating chemical or biological agents includes a first material including at least one of a Group IV or Group V metal; a second material reactive with the first material in an exothermic intermetallic reaction to generate heat sufficient to vaporize a third material; and the third material that when vaporized combusts with air producing an elevated temperature sufficient to destroy the chemical and biological agents. The device includes a container having a center core explosive driver with the self-sustaining reactive composition surrounding the center core explosive driver.

21 Claims, 3 Drawing Sheets

THERMOBARIC MATERIALS AND DEVICES FOR CHEMICAL/BIOLOGICAL AGENT DEFEAT

The U.S. Government has a paid-up license in this invention and the right in limited circumstances to require the patent owner to license others on reasonable terms as provided for by the terms of Contract No. DSWA01-96-C-1031 awarded by the United States Air Force.

FIELD OF THE INVENTION

The invention relates to self-propagating high-temperature thermobaric materials and devices for engaging and defeating chemical and biological agents.

BACKGROUND OF THE INVENTION

Proliferation of hazardous biological and chemical warfare agents has resulted in the need to develop countervailing compositions, methods and devices for destroying, or at least rendering ineffective, such agents. One important consideration in developing such compositions, methods and devices is that the chemical and biological agents must be destroyed in such a way so as to preclude or minimize the dispersing of the chemical or biological agents into the environment to thus avoid collateral damage.

The art has recognized this need and there have been attempts to provide solutions to this problem. For example, U.S. Pat. No. 6,945,175, which is incorporated herein by reference, discloses a weapon including a warhead filled with a two-stage intermetallic high-temperature incendiary device. The composition includes intermetallic constituents and an oxidizer, such as lithium perchlorate or sodium chlorate, to produce oxygen to generate oxides of the intermetallic constituents with addition of heat release. The oxidizer may also generate a biocide as a product of the reaction to defeat chemical and biological agents. The payload of the warhead also includes a plurality of bomblets for penetrating tanks, containers and other enclosures hold the biological and chemical agents, so that the high temperature reactants of the fill, including the biocide can react with the agents.

SUMMARY OF THE INVENTION

In one aspect, the invention provides a thermobaric self-sustaining reactive composition for defeating chemical or biological agents. The composition includes a first material comprising at least one of a Group IV or Group V metal; a second material reactive with the first material in an exothermic intermetallic reaction to generate heat sufficient to vaporize a third material; and the third material, which, when vaporized, combusts with air producing an elevated temperature sufficient to destroy the chemical and biological agents. According to this aspect, a preferred embodiment includes titanium as the first material and boron as the second material. The third material is preferably selected from the group consisting of an aluminum-magnesium alloy, red phosphorus, polytetrafluoroethylene and mixtures thereof. The invention according to this aspect may further include wax as an additive, such as polychlorotrifluoroethylene wax.

In a second aspect, the invention provides a method for producing a self-sustained high-temperature, high-energy environment for defeating chemical or biological agents. According to this aspect, the method provides a first step of initiating an exothermic reaction between a first material and a second material to produce an intermetallic reaction product and heat sufficient to produce a first temperature capable of vaporizing a third material. In a second step, the method includes vaporizing the third material at the first temperature. In a third step, the method includes combusting the vaporized third material and the intermetallic reaction product with air to thermobarically produce a second elevated temperature capable of destroying the chemical or biological agents. According to this aspect, the initiating step can be, for example, explosively driven or thermally propagated.

In a third aspect, the invention provides a thermobaric device for defeating chemical or biological agents. According to this aspect, the device includes a container having a center core explosive driver and a self-sustaining reactive composition for defeating the chemical or biological agents that surrounds the center core. The self-sustaining reactive composition comprises a first material that includes at least one of a Group IV or Group V metal; a second material reactive with the first material in an exothermic intermetallic reaction to generate heat sufficient to vaporize a third material; and the third material that when vaporized combusts with air producing an elevated temperature sufficient to destroy the chemical and biological agents. The invention according to this aspect can be delivered, for example, by airdrop or land carrier.

BRIEF DESCRIPTION OF THE DRAWING

The invention is best understood from the following detailed description when read in connection with the accompanying drawing. It is emphasized that, according to common practice, the various features of the drawing may not be drawn to scale. Included in the drawing are the following figures.

DETAILED DESCRIPTION OF THE INVENTION

Figure 1:
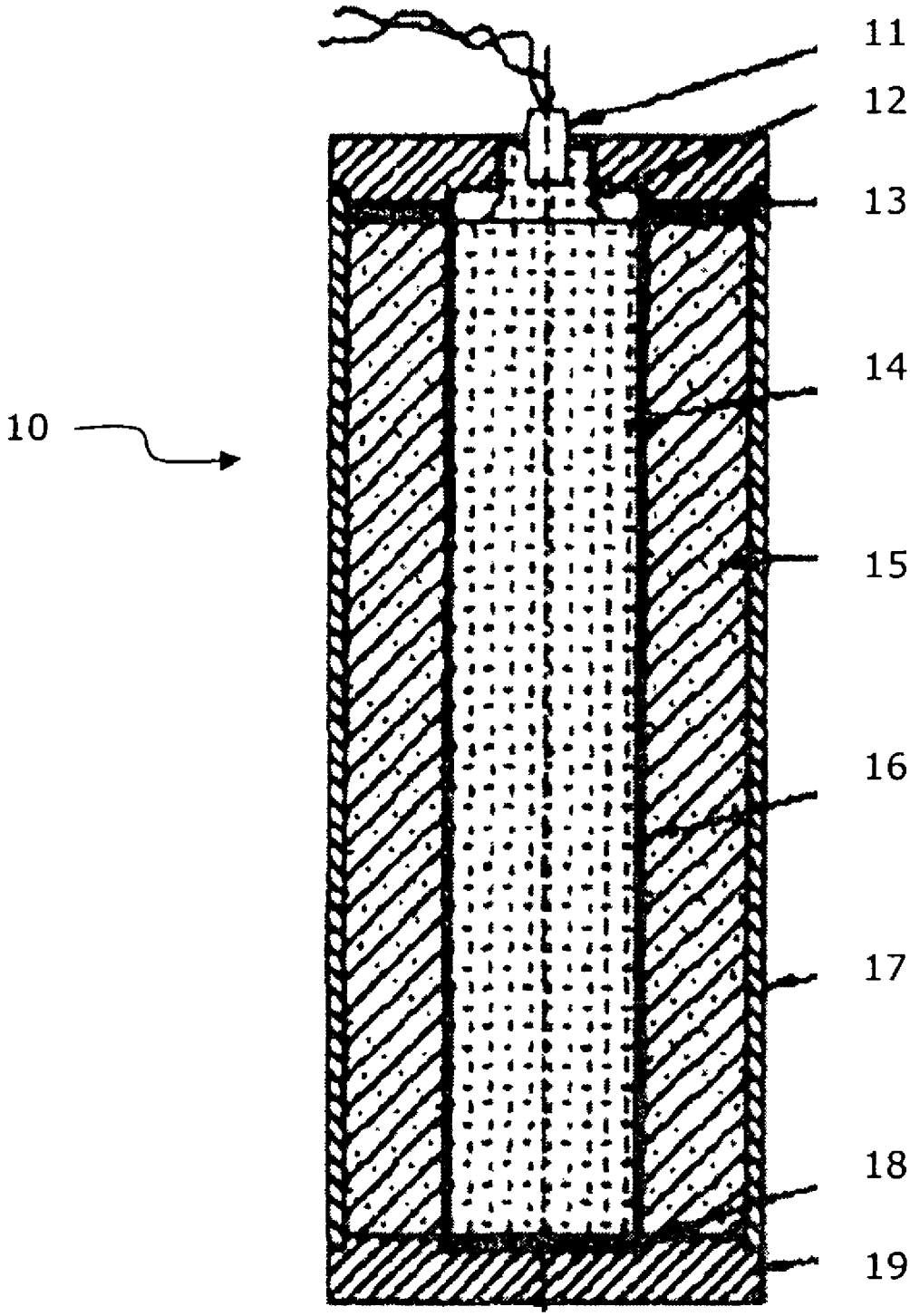
FIG. 1 is a cross sectional view of an exemplary embodiment of the invention comprising a thermobaric weapon.

The invention relates to high-temperature, high thermal energy compositions, methods and devices for producing an environment that are capable of causing the thermal degradation, combustion and chemical destruction (or otherwise render ineffective) dispersed chemical and biological agent materials, independent of chemical makeup of the biological or chemical agent material. To achieve the destruction of these harmful agents, the invention is generally directed to self-propagating high temperature reactive materials capable of self-sustaining reactions with the evolution of large quantities of thermal energy, creating an area of high temperatures (in excess of 800° C.). The high-temperature, high thermal energy environment is produced in synergism with corrosive chemical species created by the exothermic reaction of a combination of elements and compounds.

The compositions, methods and devices of the invention are designed to 1) self-react once ignited; 2) maintain a reaction until the available original material is consumed; 3) elevate additional included material to a higher energy state, where it will be more reactive with any available atmospheric and/or ambient oxygen to produce a secondary exothermic reaction to release additional thermal energy; and 4) allow additive species generated, such as fluorine, to provide synergism in destroying the agent materials.

The mechanism for producing these self-propagating high-temperature reactions begins with the reaction of intermetallic composites. Generally, reactive intermetallic composites are mixtures of two or more elemental powders that, when ignited, form an intermetallic alloy or compound. These reactions are highly exothermic with the reaction proceeding as a condensed phase steady-state reaction (self-propagating high-temperature synthesis (SHS)) according to the following general reaction:

Metal A+Element B→Intermetallic Alloy AB+Energy where 'A' metals are typically of Groups IV and V of the periodic table; and the 'B' elements are typically aluminum, boron, carbon, nitrogen and silicon.

Such intermetallic reactions proceed pyrotechnically without requiring an outside oxidizer source (such as atmospheric oxygen). Energy levels released by these types of reactions can reach 17.6 kJ/cm$^3$ (4.7 kJ/gram), which compares favorably to the energy release from the detonation of explosives (e.g. 7.1 kJ/cm$^3$ for TNT and 11.9 kJ/cm$^3$ for HMX). The temperature increase produced by intermetallic reactions can exceed 3500 K with the formation of reaction products, such as hot solid radiating particulates and sintered surfaces, molten intermetallic alloys, vaporized atoms, or combinations of these products. These reaction products can further react with atmospheric oxygen to form oxides with the energy release of an additional 49.3 kJ/cm$^3$ (13.8 kJ/gram).

Intermetallic reactions can proceed by thermal initiation with reaction propagation rates ranging from millimeters/second for long duration thermal source applications to hundreds of meters per second for quasi-static pressure and high thermal fluence generation. These reactions can also be initiated mechanically (shock initiated) with demonstrated reaction initiation occurring in the microsecond range and significant reaction occurring within 10 microseconds. The reaction kinetics of intermetallic reactions can be modified with the addition of suitable additives (e.g., oxidizers, hydrides, gas generators) to tailor the output of the reaction to meet specific program requirements.

The heat released during the exothermic reaction is suitable for raising the temperature of the ambient environment to a point capable of performing work, such as combustion or degradation of biological agents, combustion or degradation of chemical agents and combustion or thermal degradation of equipment and supplies.

In addition, it has been found that certain materials, such as aluminum-magnesium alloys, polytetrafluoroethylene, red phosphorus and combinations thereof, when mixed with the intermetallic composites, are particularly useful for chemical and biological agent defeat. This is because the intermetallic reaction is suitable for raising the temperature of the ambient environment to a point capable of raising the temperature of these other formulation components to an energy level whereby these formulation additives are capable of reaction with available atmospheric oxygen, or reaction with other components of the intrinsic formulation. Therefore, unlike conventional biological or chemical agent defeat systems, the invention does not require the use of an oxidizer as an additional component because the invention is combustible with ambient air.

Thus, the excess heat produced during the course of reaction will cause the combustion and thermal degradation of available biological and chemical agents through convective, conductive and radiative heat transfer into the biological and chemical agent materials. Equipment and supplies that are in the range of the reaction front will also be exposed to an environment of high temperatures that can affect the equipment and supplies in different ways. For example, some materials will be combusted, such as paper-based products and flammable solvents and others will be degraded or damaged thermally, such as electronic equipment, processing equipment and storage containers.

There are many benefits to using intermetallic composites in the present invention. For example, because the components of an intermetallic reaction are solid powders, the fabrication of these materials to the desired configurations can be accomplished using conventional powder metallurgy techniques. Reactive intermetallic composites are also relatively insensitive to initiation during handling, processing and storage. Moreover, intermetallic reactants are insensitive to friction, impact and environmental shock initiation. In consolidated form, intermetallic reactants are also compatible with most solid materials.

In one aspect, the invention therefore provides a thermobaric self-sustaining reactive composition for defeating chemical or biological agents, such as agents used as biological or chemical warfare agents. In an exemplary embodiment according to this aspect, the composition is based on a titanium-boron intermetallic reactive formulation, capable of producing a self-sustaining reaction with the evolution of heat.

According to this embodiment, a mixture of titanium and boron is ignited, causing the titanium and boron to react to produce titanium diboride and energy in the form of heat. The reaction mechanism proceeds as follows:

Titanium (Ti)+Boron (B)→$TiB_2$+Heat (1.2 kcal/g).

Then, the hot titanium diboride reacts with atmospheric oxygen to produce oxides of the titanium boron, as follows:

$TiB_2$(Hot)+Oxygen ($O_2$)→$TiO_2$+$B_2O_3$+Heat (5 kcal/g)

Thus, in an embodiment according to this aspect, the base mixture of titanium and boron is mixed with aluminum-magnesium alloy and polytetrafluorethylene (PTFE) and the mixture is ignited. The first exothermic reaction proceeds according to the following mechanism:

$$\text{Ti} + \text{B} + \text{Al—Mg Alloy (Al/Mg)} + \text{PTFE} \longrightarrow \text{TiB}_2 + \text{(Al + Mg) vapor} + \text{PTFE Decomposition (Fluorine, Carbon-Fluorine Molecules)} + \text{Heat (6-7 kcal/g)}$$

The reaction products produced include hot titanium diboride, gaseous aluminum-magnesium, fluorine and carbon fluorine molecules resulting from the decomposition of the polytetrafluoroethylene, and heat. In the proceeding reaction, the hot titanium diboride and gaseous aluminum-magnesium react with either of two available oxidizers, atmospheric oxygen or elemental fluorine (F), to produce oxides and fluorides, as follows:

$$\text{TiB}_2\text{ (Hot)} + \text{Al/Mg (vapor)} + \text{O}_2 + \text{F} \longrightarrow \text{TiO}_2 + \text{B}_2\text{O}_3 + \text{Al}_2\text{O}_3 + \text{MgO} + \text{TiF}_2 + \text{BF}_3 + \text{AlF}_3 + \text{MgF}_2 + \text{C} + \text{Heat (6-7 kcal/g)}$$

The developed composition is extremely energetic in that it delivers a total of (6-7) kcal/g in energy per unit mass (equal to the heat of combustion of aluminum metal) due to the multi-step reaction scheme. The reaction of titanium and boron (Ti+2B) forming titanium diboride ($TiB_2$) vaporizes the aluminum (Al) and magnesium (Mg) additives. These additives subsequently combust in air along with titanium diboride ($TiB_2$) forming oxides of aluminum (Al), magnesium (Mg), Ti (titanium) and B(boron) raising the temperature of the environment to the highest possible temperature.

In yet another exemplary embodiment according to this aspect, the formulation engages the use of red phosphorus in the presence of a titanium-boron based intermetallic reaction. The basic reaction forming titanium diboride ($TiB_2$) is exothermic enough to cause vaporization of the red phosphorus, which in turn, reacts with oxygen to release even more thermal energy in the following manner:

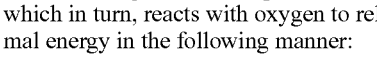

$$Ti+2B+P \rightarrow TiB_2+P\ (gas)$$

followed by

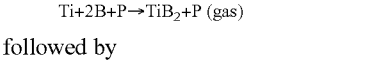

$$P+O_2 \rightarrow P_XO_Y$$

and

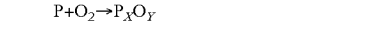

$$Ti\ B_2+O_2 \rightarrow Ti\ O_2+B_2\ O_3$$

The thermochemical environment caused by this sequence of reactions is severe enough to cause thermochemical destruction of both biological and chemical agents in a closed facility or in open air where the agent may exist as a cloud of aerosol particulates.

Additives such as fluorocarbon wax are used in the process as well. The above examples are mentioned to outline the possible representative reaction paths believed to occur during the in-atmosphere reaction of the claimed formulations. Each formulation will have its own unique set of reaction pathways under real conditions.

Preferably, the composition according to the first aspect of the invention comprises a first material of a Group IV or V metal, such as titanium, in an amount of about 15-75% by mass. The second material, which is a material selected from the group consisting of aluminum, boron, carbon, nitrogen, silicon and combinations thereof, preferably is present in an amount of about 5-40% by mass. The third material, which can be selected from the group consisting of an aluminum-magnesium alloy, red phosphorus, polytetrafluoroethylene and mixtures thereof, is preferably present in an amount of about 5 to 80% by mass.

An exemplary composition of the invention comprises about 40-60% by mass of titanium powder, about 15-30% by mass of boron powder, about 10-20% by mass of aluminum-magnesium alloy powder, about 5-15% by mass of polytetrafluoroethylene powder and about 2.5-7.5% by mass of polychlorotrifluoroethylene wax.

Another exemplary composition of the invention comprises about 20-35% by mass of titanium powder, about 7.5-15% by mass of boron powder and about 40-80% by mass of red phosphorus powder.

Still another exemplary composition of the invention comprises about 18-36% by mass of titanium powder, about 7.5-12.5% by mass of boron powder, about 4.5-9.5% by mass of aluminum-magnesium alloy powder and about 45-75% by mass of polychlorotrifluoroethylene wax.

In a second aspect, the invention provides a thermobaric self-sustaining method for producing a self-sustained high-temperature, high-energy environment for defeating chemical or biological agents. The method includes the step of initiating (e.g. explosively driving or thermally propagating) an exothermic reaction between a first material and a second material to produce an intermetallic reaction product and heat sufficient to produce a first temperature capable of vaporizing a third material. Preferably, the first material includes a Group IV or V metal, such as titanium, and the second material is an element selected from the group consisting of aluminum, boron, carbon, nitrogen, silicon and combinations thereof. The third material is preferably selected from the group consisting of an aluminum-magnesium alloy, red phosphorus, polytetrafluoroethylene and mixtures thereof. In the next step according to this aspect of the invention, the method includes the step of vaporizing the third material at the first temperature. The final step according to this aspect includes combusting the vaporized third material and the intermetallic reaction product with air to produce a second elevated temperature capable of destroying the chemical or biological agents.

In a third aspect, the invention provides a thermobaric device for defeating chemical or biological agents. This concept is particularly advantageous for destroying or rendering ineffective biological or chemical agents stored in a facility. Such a device can be used to deny further entry and eliminate agent exit and collateral damage to humans or animals downwind. The thermobaric device is preferably a weapon munition that can be affixed to a bomb or missile for delivery by airdrop or land carrier.

In an exemplary embodiment according to this third aspect, the device includes a container having a center core explosive driver, such as a small ratio of high explosive of any type known to one of ordinary skill in the art. In this exemplary embodiment, as shown in FIG. 1, the thermobaric weapon comprises a container 10 including an outer thin walled fragment casing 17, such as stainless steel. Within the outer wall is an annulus 15 comprising the thermobaric chemical and biological agent defeat material. According to this embodiment, the composition includes a first material comprising at least one of a Group IV or Group V metal; a second material reactive with said first material in an exothermic intermetallic reaction to generate heat sufficient to vaporize a third material; and the third material, which, when vaporized, combusts with air producing an elevated temperature sufficient to destroy said chemical and biological agents.

The container 10 further includes a center inner core 14 separated from the thermobaric agent defeat material by a thin-walled steel tube 16. The center core 14 comprises a high explosive (HE) driver 14. The container 10 also includes detonator 11 affixed to an ignition source 12, such as a shock initiator or flame initiator, e.g. a Comp C-4 booster or a bag igniter, respectively. A cellulose washer 13 is interposed between the ignition source 12 and the HE driver 14. The container 10 also includes cellulose disk 18 interposed between explosive driver 14 and steel tamper material 19. Upon detonation of the explosive, the steel tamper material 19 provides initial and temporary confinement of the thermobaric agent defeat material to direct the forces forward. After shock loading, the tamper material 19 disintegrates.

Figure 2:
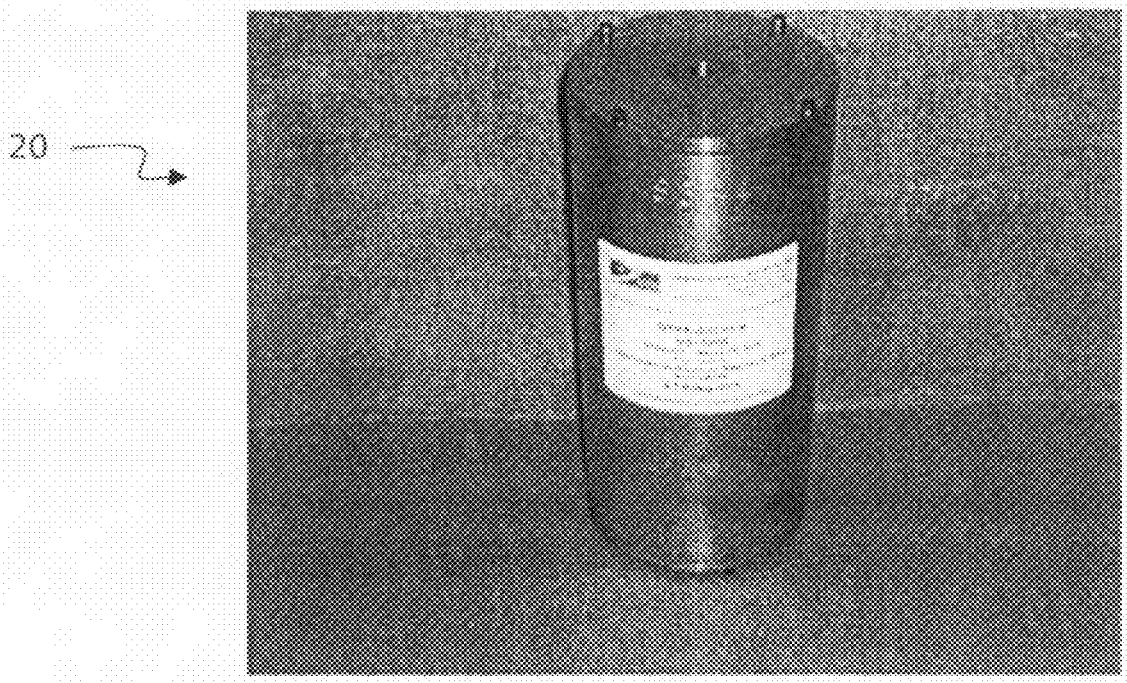
FIG. 2 is an image of a thermobaric device according to an exemplary embodiment of the invention.
Figure 3:
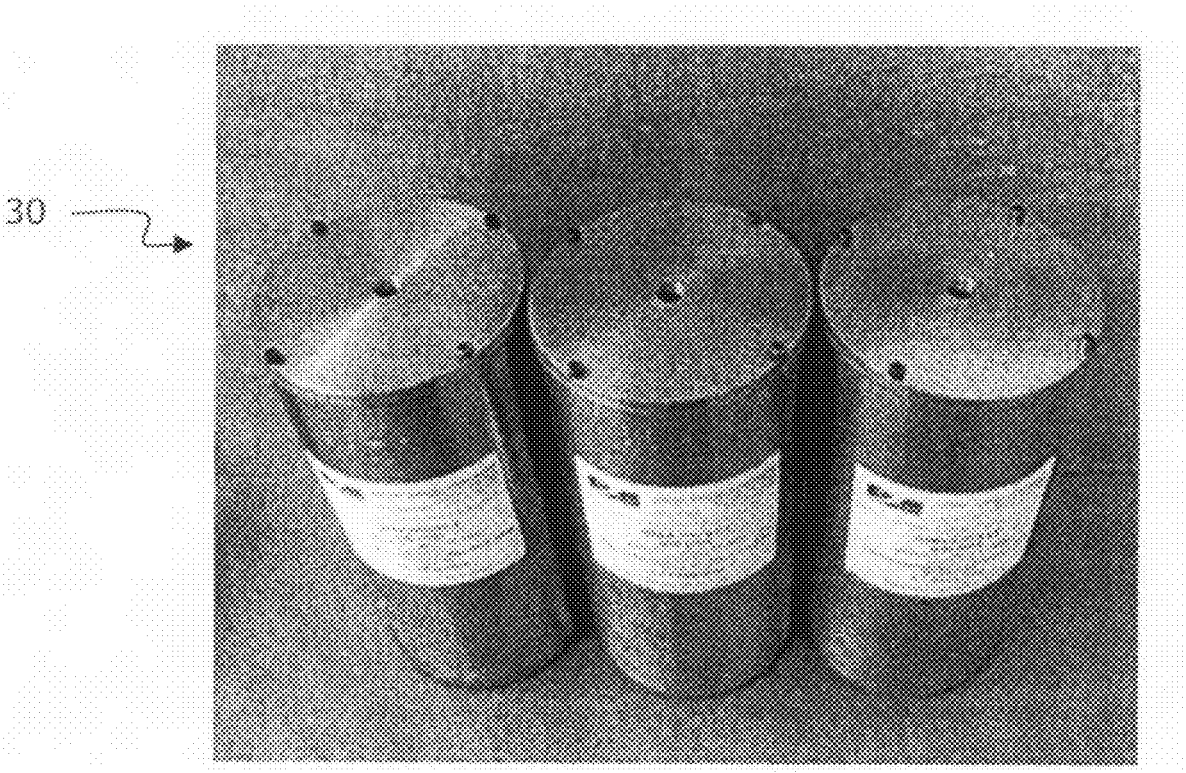
FIG. 3 is another image of thermobaric devices according to an exemplary embodiment of the invention.

FIG. 2 illustrates a thermobaric device 20 according to the exemplary embodiment, prior to explosives filling. FIG. 3 is another illustration of thermobaric devices 30 ready for installation of the explosive filling. Once the explosive is added, the device is ready for use.

According to this embodiment, ignition of the explosive core 14 ignites and disperses the thermobaric composition and breaks the steel case 17 into small fragments. These fragments travel at high speed and impinge on storage containers causing the chemical or biological agent to aerosolize in the closed facility. The aerosolized biological or chemical agent is engulfed by the thermochemical environment produced by the thermobaric weapon and is destroyed before it has a chance to exit the facility.

Advantageously, this device configuration can also be used to enhance impulse (and blast, if necessary) by increasing the ratio of high explosive (HE) to thermobaric agent defeat composition. In addition, as noted previously, because the thermobaric device does not require an oxidizer other than ambient air, the weight of the device is reduced by approximately half that of conventional devices that require an oxidizer component. Moreover, because the biological and chemical storage containers are opened by the fracturing of the case of the agent defeat container, the device does not require the use of additional means, such as bomblets, for opening the containers.

EXAMPLES

Exemplary formulations for the biological and chemical defeat compositions according to the invention are provided in the following tables.

Example 1

To prepare the exemplary composition, titanium, boron, aluminum-magnesium, polytetrafluoroethylene (PTFE) and polytetrachlorotrifluoroethylene (PCTFE) are mixed as dry powders, in the amount as indicated below. The mixture is blended through rolling, and is ready for final loading into a device.

Example 1 GSI-0005™

| Component | % by mass |
|---|---|
| Titanium powder | 48.22 |
| Boron powder | 21.78 |
| Aluminum-magnesium alloy powder | 15 |
| Polytetrafluoroethylene (PTFE) | 10 |
| Polytetrachlorotrifluoroethylene (PCTFE) | 5 |

Example 2

To prepare this exemplary composition, titanium, boron and red phosphorus are mixed as dry powders, in the amount as indicated below. The mixture is blended through rolling, and is ready for final loading into a device.

Example 2 GSI-0018™

| Component | % by mass |
|---|---|
| Titanium powder | 27.55 |
| Boron powder | 12.44 |
| Red phosphorus | 60 |

Example 3

In contrast to Examples 1 and 2, Example 3 is considered a melt-cast material. For this exemplary composition, titanium, boron, aluminum-magnesium alloy and polytetrafluoroethylene powders are dry blended together to form a precursor material. When final loading is desired, the polychlorotrifluoroethylene (PCTFE) wax is loaded into the device and heated at 165° C. until fully melted. Then, the dry blended precursor mix is added to the melted wax and stirred in until homogenous. The device is allowed to cool to room temperature and is considered ready for use.

Example 3 GSI-0033™

| Component | % by mass |
|---|---|
| Titanium powder | 22.90 |
| Boron powder | 9.96 |
| Aluminum-magnesium alloy powder | 7.12 |
| Polytetrachlorotrifluoroethylene (PCTFE) | 60 |

Although preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed is:

1. A thermobaric self-sustaining reactive composition for defeating chemical or biological agents comprising:

a first material comprising at least one of a Group IV or Group V metal;

a second material reactive with said first material in an exothermic intermetallic reaction to generate heat sufficient to vaporize a third material;

said third material, which, when vaporized, combusts with air producing an elevated temperature sufficient to render ineffective said chemical or biological agents, wherein said composition is capable of producing said elevated temperature in the absence of an oxidizer as a component of the composition.

2. The composition of claim 1 wherein said first material is titanium.

3. The composition of claim 1 wherein said first material is present in an amount of from about 15-75% by mass.

4. The composition of claim 1 wherein said second material is selected from the group consisting of aluminum, boron, carbon, nitrogen, silicon and combinations thereof.

5. The composition of claim 1 wherein said second material is present in an amount of about 5-40% by mass.

6. The composition of claim 1 wherein said third material is present in an amount of about 5-80% by mass.

7. The composition of claim 1 further comprising wax.

8. The composition of claim 1 wherein said wax is polychlorotrifluoroethylene wax.

9. The composition of claim 1 wherein said composition comprises about 40-60% by mass of titanium powder, about 15-30% by mass of boron powder, about 10-20% by mass of aluminum-magnesium alloy powder, about 5-15% by mass of polytetrafluoroethylene powder and about 2.5-7.5% by mass of polychlorotrifluoroethylene wax.

10. The composition of claim 1 wherein said composition comprises about 20-35% by mass of titanium powder, about 7.5-15% by mass of boron powder and about 40-80% by mass of red phosphorus powder.

11. The composition of claim 1 wherein said composition comprises about 18-36% by mass of titanium powder, about 7.5-12.5% by mass of boron powder, about 4.5-9.5% by mass of aluminum-magnesium alloy powder and about 45-75% by mass of polychlorotrifluoroethylene wax.

12. The composition of claim 9 comprising about 48.22% by mass of titanium powder, about 21.78% by mass of boron powder, about 15% by mass of aluminum-magnesium alloy powder, about 10% by mass of polytetrafluoroethylene powder and about 5% by mass of polychlorotrifluoroethylene wax.

13. The composition of claim 10 comprising about 27.55% by mass of titanium powder, about 12.44% by mass of boron powder and about 60% by mass of red phosphorus powder.

14. The composition of claim 11 comprising about 22.90% by mass of titanium powder, about 9.96% by mass of boron powder, about 7.12% by mass of aluminum-magnesium alloy powder and 60% by mass of polychlorotrifluoroethylene wax.

15. A thermobaric device for defeating chemical or biological agents comprising:

a container having a center core explosive driver and a self-sustaining reactive composition for defeating said agents surrounding said center core explosive driver;

wherein said self-sustaining reactive composition comprises:

a first material comprising at least one of a Group IV or Group V metal;

a second material reactive with said first material in an exothermic intermetallic reaction to generate heat sufficient to vaporize a third material; and said third material, which, when vaporized, combusts with air producing an elevated temperature sufficient to render ineffective said chemical or biological agents, wherein said composition is capable of producing said elevated temperature in the absence of an oxidizer as a component of the composition.

16. The thermobaric device of claim 15 wherein said first material is a titanium.

17. The thermobaric device claim 15 wherein said second material is selected from the group consisting of aluminum, boron, carbon, nitrogen, silicon and combinations thereof.

18. The thermobaric device of claim 15 wherein said container is configured to be delivered by airdrop or land carrier.

19. The composition of claim 1, wherein said composition is absent an oxidizer.

20. The thermobaric device of claim 15, wherein said composition is absent an oxidizer.

21. A thermobaric self-sustaining reactive composition for defeating chemical or biological agents consisting of:

a first material comprising at least one of a Group IV or Group V metal;

a second material reactive with said first material in an exothermic intermetallic reaction to generate heat sufficient to vaporize a third material;

said third material, which, when vaporized, combusts with air producing an elevated temperature sufficient to render ineffective said chemical or biological agents; and optionally at least one additive such as wax, wherein said composition is absent an oxidizer.

* * * * *